United States Patent [19]

Dougherty

[11] 4,028,580

[45] June 7, 1977

[54] SHADOW MASK MOUNT AND FUNNEL-FACEPLATE REFERENCING SYSTEM FOR COLOR CRT

[75] Inventor: Lawrence W. Dougherty, West Dundee, Ill.

[73] Assignee: Zenith Radio Corporation, Glenview, Ill.

[22] Filed: Nov. 25, 1974

[21] Appl. No.: 527,001

[52] U.S. Cl. ..... 313/406; 220/2.1 A

[51] Int. Cl.[2] ..... H01J 29/07; H01J 31/20

[58] Field of Search ..... 313/406, 402, 404, 405, 313/407, 408, 403, 456, 482

[56] References Cited

UNITED STATES PATENTS

| | | | |
|---|---|---|---|
| 2,824,990 | 2/1958 | Haas | 313/402 |
| 3,363,129 | 1/1968 | France et al. | 313/408 |
| 3,735,179 | 5/1973 | Kaplan | 313/406 X |
| 3,971,490 | 7/1976 | Conger | 313/482 X |

*Primary Examiner*—Robert Segal
*Attorney, Agent, or Firm*—John H. Coult

[57] ABSTRACT

This disclosure depicts a color cathode ray tube including a shadow mask and improved suspension devices for suspending the mask adjacent the faceplate of the tube. The disclosure stresses channel-shaped studs comprising part of the suspension devices. Each of the studs has a first portion adapted to be embedded in the faceplate and a second portion having provision for coupling the stud to the shadow mask. The studs engage reference surfaces on the funnel when the faceplate and funnel are mated and serve to thereby reference the faceplate to the funnel.

3 Claims, 11 Drawing Figures

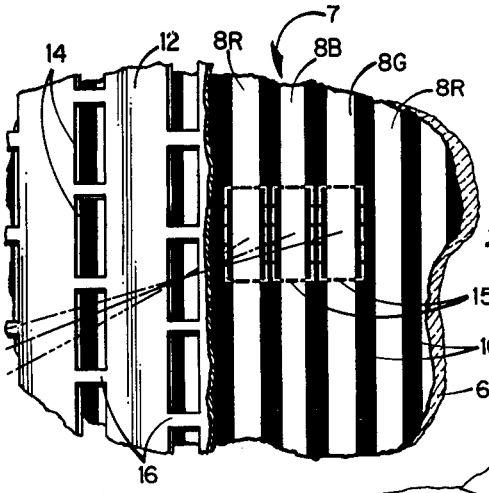
FIG. 2
FIG. 5
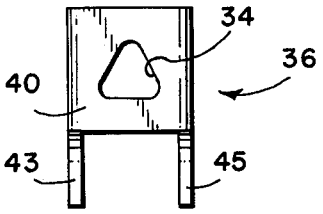
FIG. 3
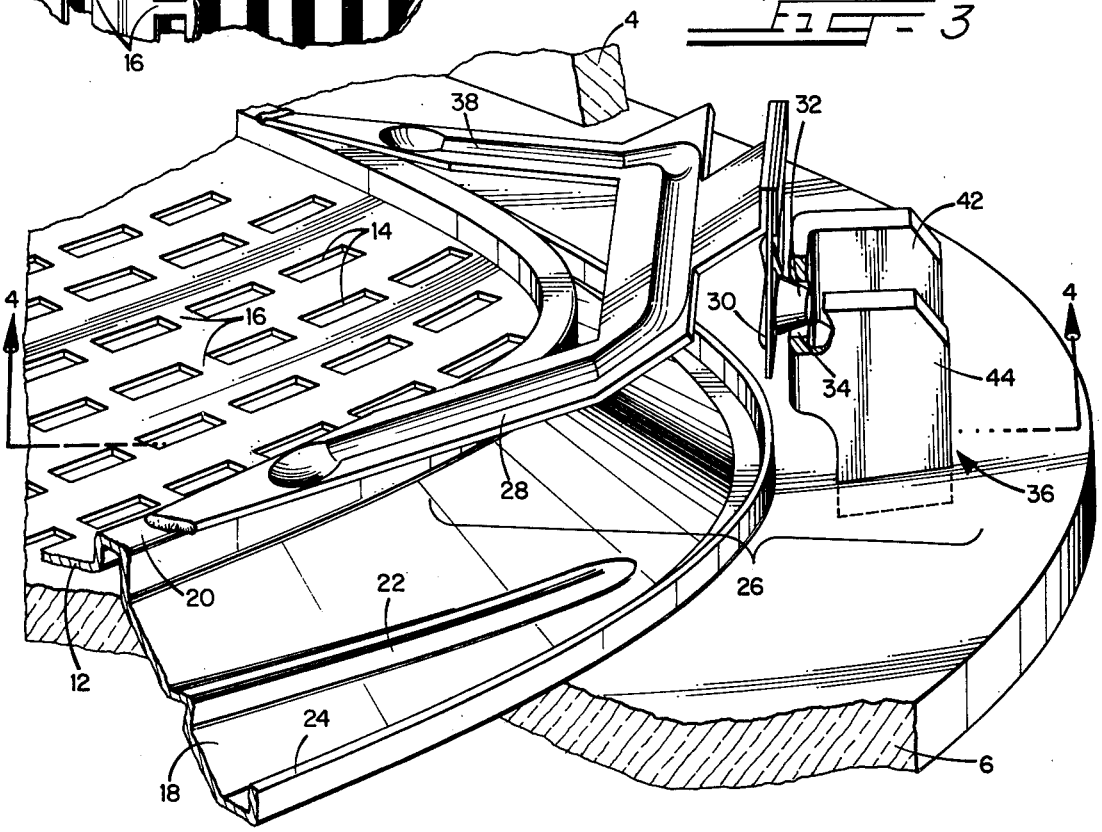
FIG. 4
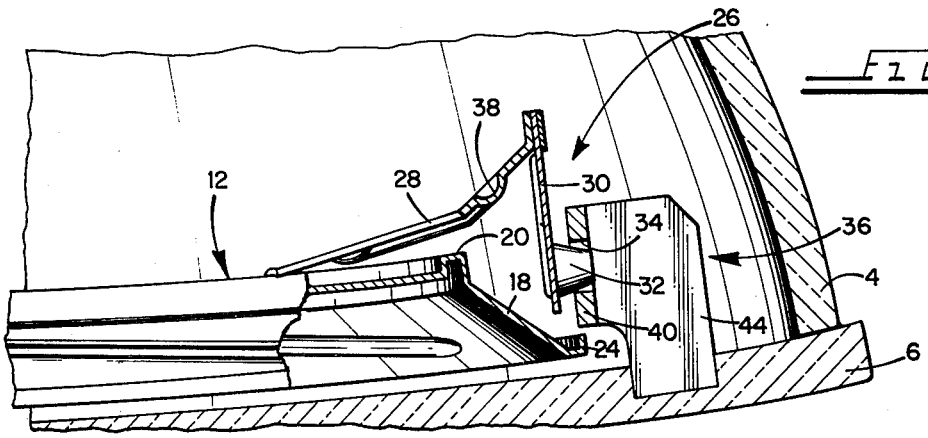

110
116
118
108
124
126
122
121
114
120
112
104
81
126
124
122
94
98
102
138
86
106
121
130
92
84
88
96
90
100
82

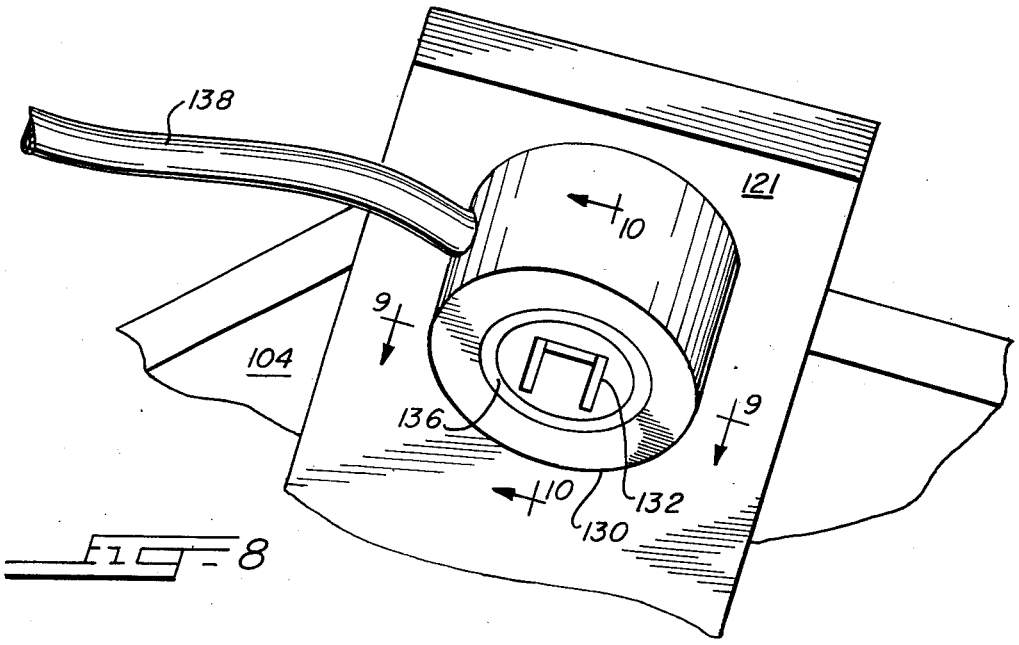
FIG. 8
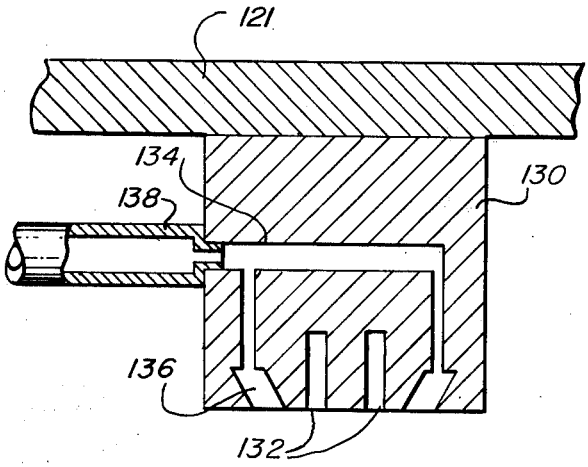
FIG. 9
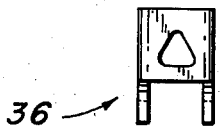
FIG. 10
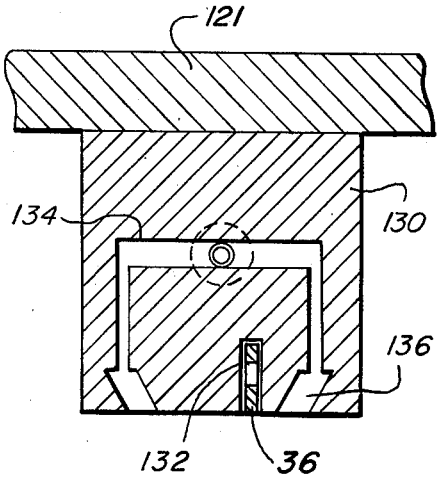

SHADOW MASK MOUNT AND FUNNEL-FACEPLATE REFERENCING SYSTEM FOR COLOR CRT

CROSS-REFERENCE TO RELATED APPLICATION

This application is related to but in no way dependent upon copending applications including Ser. No. 285,985, filed Sept. 5, 1972; (abandoned in favor of appliction Ser. No 675,653, filed Apr. 12,1976, a second generation continuation thereof) Ser. No 395,334, filed Sept. 7, 1973; Ser. No. 424,017, filed Dec. 12, 1973; Ser. No. 428,176, filed Dec. 26, 1973 (now U.S. Pat. No. 3,890,526) Ser. No. 446,845. filed Feb. 28, 1974; Ser. No. 462,915, filed Apr. 22, 1974; (now U. S. Pat. No. 3,971,490) (now U.S. Pat. No. 3,999,098), all assigned to the assignee of the present invention.

BACKGROUND OF THE INVENTION

This invention relates generally to color cathode ray tubes of the type having a shadow mask, and more particularly to structures for suspending a shadow mask, and more particularly to structures for suspending a shadow mask in a color tube and for referencing the color tube faceplate to its associated funnel. The invention is especially concerned with an improved stud comprising part of each of a plurality of mask suspension devices and also part of a faceplate-funnel referencing system.

Conventional color cathode ray tubes have a glass envelope which comprises a flanged front panel sealed to a funnel. A shadow mask is supported adjacent to a phosphor screen pattern deposited on the inner surface of a faceplate portion of the front panel. The mask is supported on studs embedded in the inner surface of the front panel flange. A neck for housing electron guns for the tube is sealed to the funnel.

Proper tube operation requires that the shadow mask be suspended at a precise distance from the phosphor screen pattern and at a precise orientation relative thereto. Proper tube operation also requires that the phosphor screen pattern and the aperture pattern in the associated shadow mask be aligned with respect to the effective source of electron beams in the assembled tube in the same way that they were aligned with respect to an effective point light source used to screen the phosphor pattern on the faceplate. If this corresponding relative alignment is not established, color purity errors will inevitably be exhibited in the images displayed by the end-product tube.

This invention is especially useful when embodied in a novel type of shadow mask color tube having a flangeless faceplate on the inner surface of which is suspended the shadow mask. This novel tube has a lightweight, frameless, torsionally flexible shadow mask which is supported by four suspension devices — one at each corner of the mask.

This suspension arrangement has a number of unique requirements which are not imposed on conventional mask suspension systems, including the requirement that because of their corner location, such suspension devices must be particularly compact so as not to require an undesirably large tube envelope.

OBJECTS OF THE INVENTION

It is an object of this invention to provide, especially in a color tube of a novel type having a flangeless faceplate, an improved mask suspension system and faceplate-funnel referencing system.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 2 represents an enlargement of a screen portion of the FIG. 1 tube;

FIG. 3 is an enlarged fragmentary perspective view, shown partially sectioned and broken away, of a corner of the tube shown in FIG. 1, revealing with particular clarity one of the suspension devices for mounting a shadow mask on the tube faceplate;

FIG. 4 is a sectional view taken generally along the lines 4—4 in FIG. 3;

FIG. 5 is an isolated front elevational view of a stud shown in FIGS. 1 and 3–4 and constituting an important aspect of this invention;

FIGS. 7–10 depict apparatus for embedding in the faceplate the studs shown in FIGS. 1 and 3–5.

DESCRIPTION OF THE PREFERRED EMBODIMENT

Figure 1:
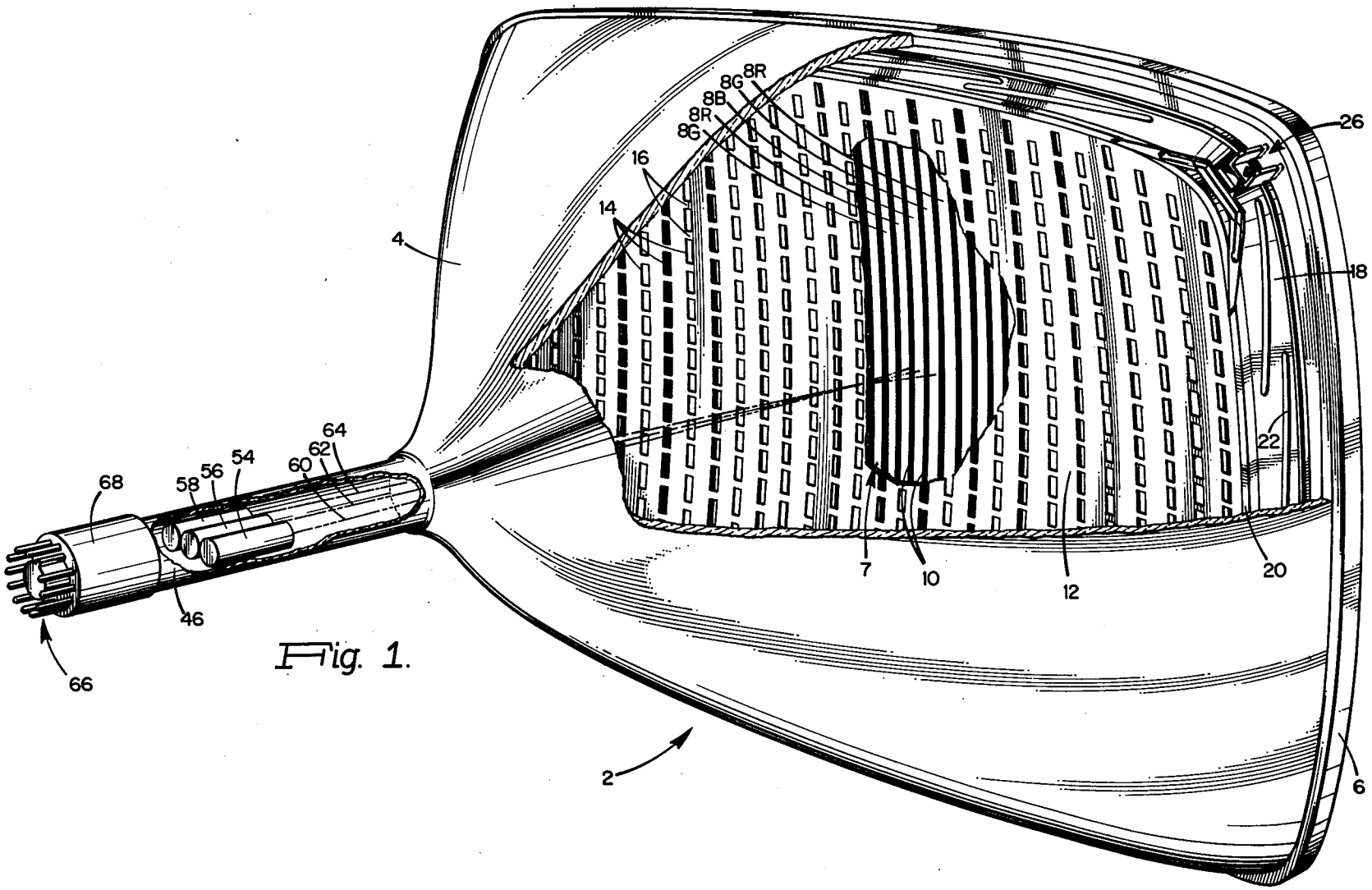
FIG. 1 is a schematic perspective view of a novel color cathode ray tube embodying the teachings of the present invention; certain parts are shown in exaggerated dimension for clarity of illustration.

FIGS. 1–5 illustrate a shadow mask-type color tube 2 implementing the principles of this invention. The illustrated tube 2 is shown as having a novel envelope comprising a funnel 4 sealed to a flangeless faceplate 6. The novel construction of the faceplate 6 without a flange permits economies in manufacture of the envelope and simplified and economical screening processes. On the inner surface of the faceplate 6 is disposed a phosphor screen 7. Whereas the screen 7 may take any of a wide variety of other configurations such as the conventional dot screen configuration, in the illustrated embodiment it is shown as comprising an array of vertically oriented, horizontally repeating triads of red-emissive, blue-emissive and green-emissive phosphor elements 8R, 8B and 8G. The screen is preferably of the negative guard-band, black surround-type as taught to the world by the patent to Fiore et al., U.S. Pat. No. 3,146,368, including a black grille 10. The grille 10 comprises a pattern of light-absorptive bands separating the phosphor elements 8R, 8B and 8G.

A shadow mask 12 of novel construction, described below, has formed therein a pattern of slot-type apertures 14, each aperture being separated from its neighboring slots by a "tie bar" 16.

The shadow mask structure is not the subject of this invention, being described and claimed specifically in the referent copending applications Ser. Nos. 285,985 and Ser. No. 395,334. Briefly, the shadow mask 12 is preferably of a frame-less, one-piece construction formed from a single sheet of electrically conductive material such as steel. An integral skirt 18 provides rigidity for the mask and shields the screen 7 from stray and overscanned electrons. Integrally formed channel 20, ribs 22 and edge lip 24 cause the mask 12 to be relatively stiff with respect to the major and minor axes thereof, while permitting the mask to flex with respect to its diagonals and thereby conform, when mounted, to the contour of the faceplate.

A suspension system of novel construction is provided for supporting the shadow mask 12 in spaced adjacency to the inner surface of the faceplate 6. The suspension system, in its broadest aspects, is not the subject of this application, being described and claimed in the following patents, inter alia, all assigned to the assignee of the present invention: U.S. Pat. Nos. 3,896,321; 3,890,526; and 3,999,098. In a narrower aspect, the suspension system shown is a part of this invention, as will be described in detail hereinafter.

The suspension system preferably comprises four suspension devices 26, one at each corner of the mask 12. As noted, the shadow mask 12 is constructed so as to be relatively rigid with respect to its major and minor axes, but less rigid with respect to its diagonals. By mounting the suspension devices 26 at the corners of the mask 12, unit-to-unit deviations in the faceplate with respect to the faceplate diagonals are followed by corresponding flexure of the shadow mask 12 so as to maintain a constant "Q " spacing, i.e., a constant spacing between the central apertured portion of the shadow mask 12 and the inner surface of the faceplate 6 carrying the phosphor screen 7.

Although numerous other arrangements are contemplated, in the illustrated preferred suspension system, the suspension devices 26 each comprise a bracket 28 mounted on a corner of the mask which carries a relatively low rate, but laterally stiff, spring 30. The bracket 28 preferably has embossed therein stiffening corrugations 38. The spring 30 carries on its distal end a lug 32 which is received within a lug-receiving opening 34 in a faceplate-mounted stud 36 when the mask 12 is mounted in its operative position on the faceplate 6. Stud 36 is at the heart of the present invention, as will be pointed out after completion of the overview description of the tube 2.

As shown in FIG. 1, the tube 2 has a neck 46 within which is contained an electron gun assembly. The electron gun assembly may take any of a variety of constructions, but in the illustrated embodiment wherein the mask is a slot mask cooperating with a screen of the "line"-type, the electron gun assembly preferably is of the "in-line"-type, wherein three separate guns 54, 56, 58 generate three coplanar beams 60, 62, 64 intended to carry, respectively, red-associated, blue-associated and green-associated color video information. The electron gun assembly is electrically accessed through pins 66 in the base 68 of the tube.

The present invention will now be described in detail. As noted, at the crux of the present invention is the novel dual-purpose stud 36. In one aspect the stud serves as a light-weight, compact, strong and relatively low cost element for supporting the shadow mask 12. In accordance with this invention, the stud 36 has a channel shape with a face 40 containing the lug-receiving opening 34 and two flanges 42, 44 which are embedded in (or which may be cemented to) the faceplate 6. The illustrated preferred form of the stud is not this invention, per se. According to the said preferred form, the flanges 42, 44 on the stud 36 have end extensions defining a pair of legs 43, 45. The spaced legs 43, 45 are embedded in the inner surface of the faceplate 6 such that the face 40 is disposed radially inwardly of the legs 43, 45 and such that the face 40 is elevated above the inner surface of the faceplate and oriented perpendicular to a diagonal of the faceplate. It should be noted that by the described stud construction, the face is disposed radially inwardly of the legs 43, 45. The glass fillets at the base of the legs 43, 45 caused by the stud hot sealing insertion operation will thus not intrude upon the usable image area of the faceplate. Secondly, the face 40 is supported very close to the edge of the mask. The compactness of the suspension device 26 is thus enhanced. Thirdly, by the provision of the legs 43, 45 which elevate the face 40 above the inner surface of the faceplate 6, during screening of the faceplate screening fluids which are suffused across the inner surface of the faceplate pass between and around the legs 43, 45 of the studs 36 and do not backwash onto the image area. There is thus prevented the creation of non-uniformities in the coatings deposited upon the screen during the various screening processes. Also, the stud 36, particularly the opening 34 in the stud 36, is maintained free of clogging by the screening fluids.

The channel shape of the stud gives it a high degree of strength and rigidity in spite of its lightweight and low mass. The studs 36 may be each formed by a stamping operation and may be composed, for example, of No. 446 stainless steel.

The lug-receiving openings 34 in three of the four studs 36 are preferably circular or triangular and define the spatial position of the mask 12 relative to the faceplate 6. The lug receiving opening 34 in the redundant fourth stud 36 is preferably elongated in a direction parallel to the inner surface of the faceplate 6, permitting the fourth lug to seek an equilibrium position and preventing disturbance of the mask position which is determined by the other three studs 36. To insert or remove the mask 12, the springs 30 are depressed until the lugs 32 clear the lug-receiving openings 34 in the studs 36.

Figure 6:
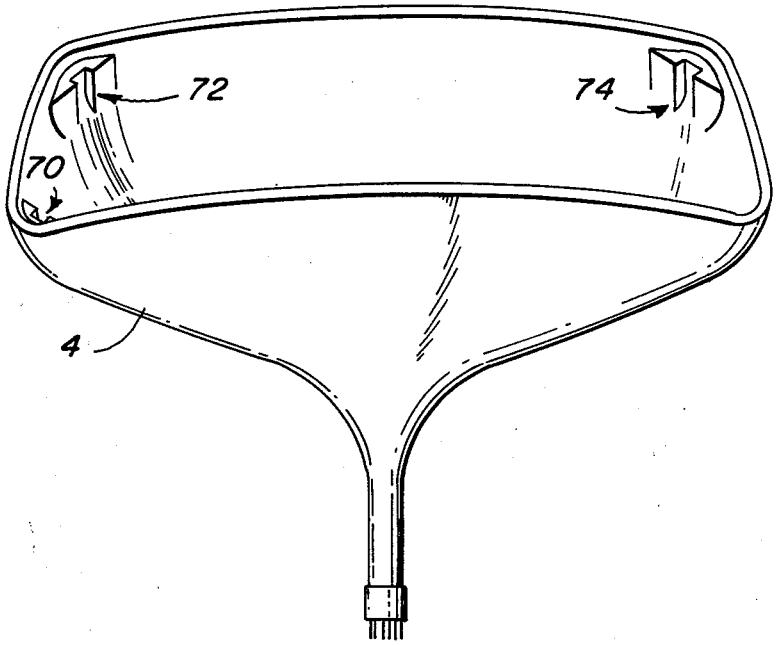
FIG. 6 is a perspective view of a funnel portion of the cathode ray tube shown in FIGS. 1–5.
Figure 6A:
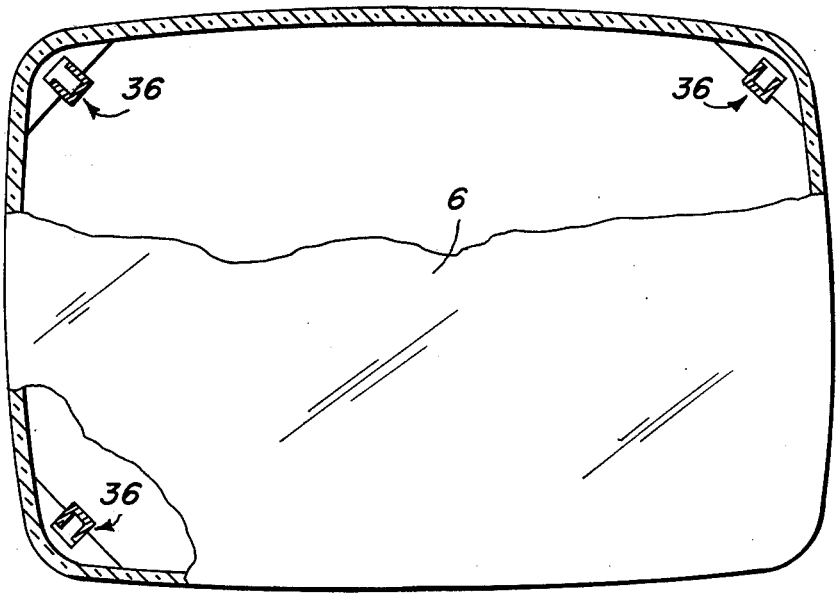
FIG. 6A is a plan view of the funnel shown in FIG. 6, illustrating how the faceplate-mounted studs are captured by notches in the funnel corners.
Figure 7:
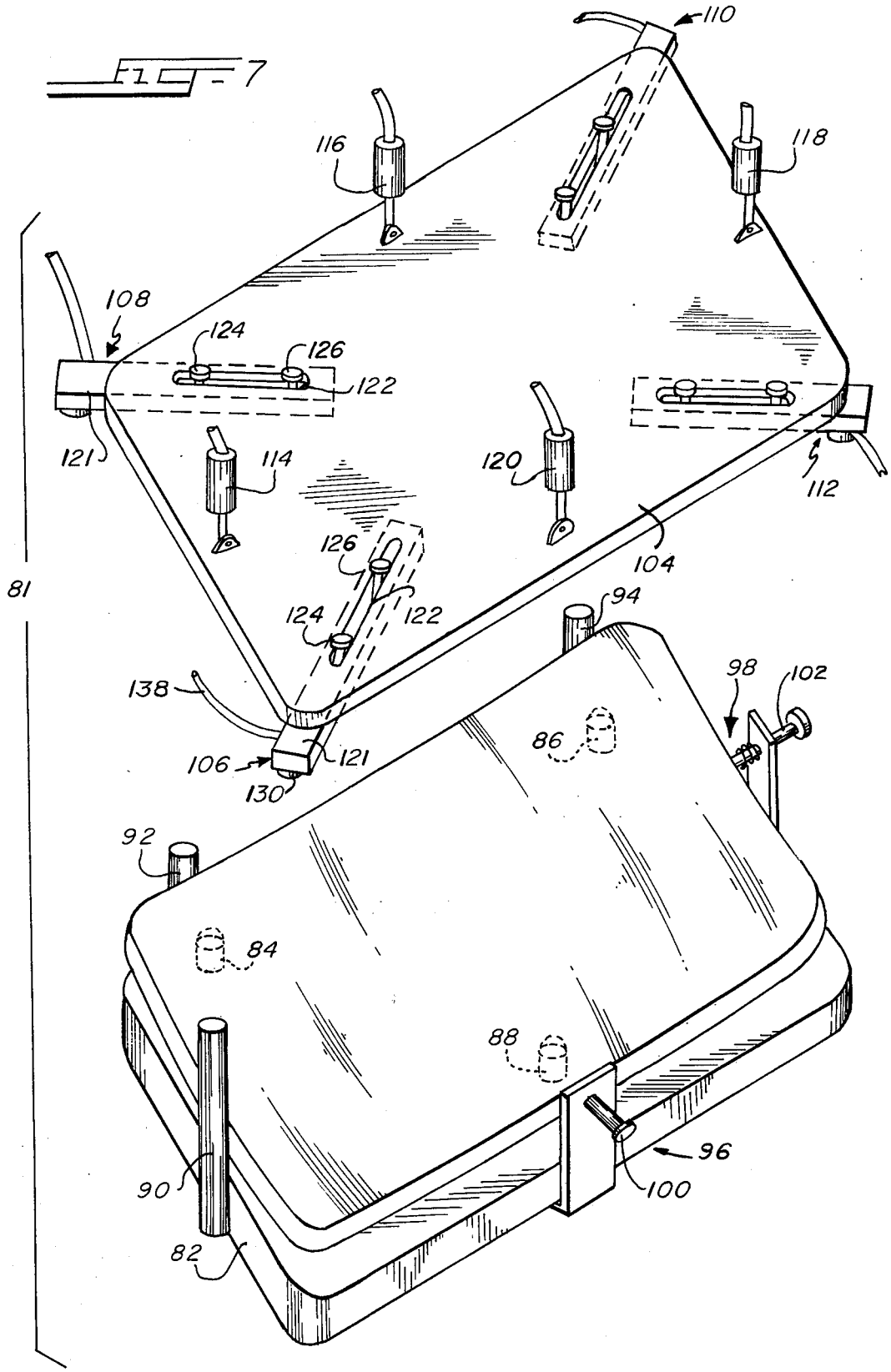

In another aspect, the stud 36 serves to define faceplate reference surfaces which engage reference surfaces on the funnel when the faceplate and funnel are mated and cemented together, typically by a high temperature sealing operation in which a devitrifying solder glass of "frit"is cured. Specifically, the flanges 42, 44 on three of the studs 36 define three pairs of spaced faceplate reference surfaces which engage, in a preferred embodiment, the sides of notches 70, 72 and 74 formed integrally in three corners of the funnel 4 when the faceplate 6 and funnel 4 are joined. See FIGS. 6 and 6A. The engagement of six faceplate reference surfaces with six funnel reference surfaces uniquely determines the fixed relative positions of the faceplate 6 and funnel 4 along the X and Y tube axes, as well as in azimuth. By appropriate positioning of the studs 36 in faceplate 6, by appropriate referencing of the location of the electron guns to the notches 70, 72, 74 on the funnel 4, and by appropriate referencing of the screen phosphor pattern to the studs (as by using a screening master or shadow mask mounted on the studs 36 during photoprinting of the screen), the electron guns are caused to be referenced to the phosphor screen.

FIGS. 7–10 schematically depict a fixture 81 for embedding the studs 36 in the faceplate 6. The FIGS. 7–10 apparatus is illustrated as including a base 82 from which projects three carbon-tipped support rods 84, 86, 88 for supporting the faceplate 6. Three alignment posts 90, 92, 94 serve to align the faceplate 6. A pair of clamping assemblies 96, 98 include spring-biased, carbon-tipped pistons 100, 102 which urge the faceplate against the alignment posts 90–94. The fixture 81 is illustrated as including a platen 104 which supports four substantially identical chuck-burner assemblies 106, 108, 110, 112. The platen 104 is raised and lowered by means of air cylinders, shown schematically at 114, 116, 118 and 120.

Each of the chuck-burner assemblies 106–112 is illustrated as comprising a slide bar 131 which is adjustable along the faceplate diagonal by means of a slot 122 in the platen 104 and a pair of threaded bolts 124, 126. Each of the chuck-burner assemblies 106–112 supports on the outermost end thereof a chuck 130, shown with particular clarity in FIGS. 8–10. The chuck 130 includes a cavity 132 having a configuration corresponding to that of the stud 36 to be chucked, and a gas manifold comprising a gas passageway 134 leading to an annular combustion chamber 136 surrounding the cavity 132. A gas hose 138 is coupled to the passageway 134 to conduct gas to the combustion chamber 136. The platen 104 is shown elevated above its normal operating position in order to more clearly reveal the base 82 and associated structures.

In operation, to embed four studs 36 in the faceplate 6, the studs 36 are loaded into the chucks 130 and secured (by means not shown). The gas is ignited in the combustion chamber 136 and the studs are preheated. The platen 104 is then lowered by means of the air cylinders 114–120 into proximity with the faceplate 6 to cause the faceplate 6 to be heated locally until plastic in the regions where the studs 36 are to be embedded. As the platen is lowered, the platen 104 engages the alignment posts 90–94, thus assuring alignment thereof with respect to the faceplate 6.

When the faceplate 6 has been heated sufficiently, the platen 104 is lowered until the chucks 130 engage the upper surface of the faceplate 6. The chucks 130 thus serve, not only to hold the studs 36 and to act as burners for heating the studs and the faceplate, but also act as depth gauges to precisely predetermine the degree of penetration of the studs 36 into the faceplate 6.

After the studs have been embedded, the burners are shut off and the seal is permitted to cool. When the seal has become sufficiently rigid to support the studs, the platen 104 is withdrawn. Whereas the FIGS. 7–10 stud embedding apparatus is shown as employing burners for heating the studs, it is a well-known alternative to use RF heating coils to superheat the studs prior to embedment in a cathode ray tube envelope. The FIGS. 7–10 fixture is intended to be schematic only; the particular apparatus and method employed for embedding the studs, per se, constitute no part of this invention. Rather than embedding the studs in a cooled panel by the use of an alignment fixture, as described, the studs may be embedded in the faceplate during the faceplate molding operation.

The invention is not limited to the particular details of construction of the embodiments depicted and other modifications and applications are contemplated. For example, whereas the suspension device illustrated has been shown as having a particular construction, the principles of this invention can be employed to provide studs having other configurations and studs useful in other types of suspension devices and faceplate-funnel referencing systems. Other changes may be made in the above-described apparatus without departing from the true spirit and scope of the invention herein involved, and it is intended that the subject matter in the above depiction shall be interpreted as illustrative and not in a limiting sense.

What is claimed is:

1. In a rectangular-type color cathode ray tube, the combination comprising:

an approximately rectangular, curved, flangeless faceplate having studs embedded in the four corners thereof and extending from a common concave inner surface of said faceplate, said studs each having a channel shape with a face section flanked by a pair of radially outwardly extending flanges, said studs each having a first end portion embedded in said faceplate and a second portion extending from the faceplate, said second portion having provision in said face section for coupling said stud to a shadow mask, said flanges of said stud constituting spaced faceplate reference surfaces;

a funnel having an approximately rectangular mouth sealed to said faceplate and provided in each of three corners of the mouth in registry with three of said studs, a pair of inside funnel reference surfaces, said pairs of funnel reference surfaces being oriented, located and spaced so as to respectively capture and make referencing engagement with said pairs of faceplate reference surfaces when the faceplate and funnel are mated, said faceplate and funnel reference surfaces uniquely determining the location of said faceplate relative to said funnel; and a shadow mask and mounting means on each corner of said mask for retentively engaging said provision on said studs such that said mask is supported adjacent said faceplate inner surface.

2. The combination defined by claim 1 wherein each of said studs is a stamping formed from sheet metal stock and having a generally U-shaped cross-sectional configuration, said provision in said second portion comprising an aperture.

3. The combination defined by claim 2 wherein said mounting means each include a corner-mounted bracket carrying a spring, on which spring is a tapered lug for making retentive engagement with said aperture in the respectively associated stud.

* * * * *